United States Patent [19]

Lancaster

[11] Patent Number: 4,597,578

[45] Date of Patent: Jul. 1, 1986

[54] GOLF CLUB GRIP

[75] Inventor: John B. Lancaster, Wagram, N.C.

[73] Assignee: Eaton Corporation, Cleveland, Ohio

[21] Appl. No.: 712,334

[22] Filed: Mar. 14, 1985

Related U.S. Application Data

[63] Continuation of Ser. No. 580,330, Feb. 15, 1984, abandoned.

[51] Int. Cl.[4] ..... A63B 53/14

[52] U.S. Cl. ..... 273/81 R

[58] Field of Search ..... 273/81 R, 81 B, 81 D, 273/81.3

[56] References Cited

U.S. PATENT DOCUMENTS 2,781,196 2/1957 Brandon ..... 273/81.3

3,837,647 9/1974 Jacques ..... 273/81 R

*Primary Examiner*—William H. Grieb

*Attorney, Agent, or Firm*—C. H. Grace; C. J. Toddy

[57] ABSTRACT

The invention relates to a golf club grip having a knob at the cap end of the grip with the top third of the grip slightly undersized to help promote hand and wrist action for added power and with less taper and more uniform size at the lower two thirds of the grip to discourage over controlling the club.

1 Claim, 3 Drawing Figures

GOLF CLUB GRIP

This application is a continuation of Ser. No. 06/580,330 filed Feb. 15, 1984, now abandoned.

The present invention relates to a golf club grip having a knob at the cap end of the grip with the top third of the grip slightly undersized to help promote hand and wrist action for added power, and with a less taper and more uniform size at the lower two-thirds of the grip to discourage over controlling the club, permitting a smoother more natural release of the club during the swing.

Golf club grips of conventional construction have an external surface of the grip, which when mounted on the shaft of a golf club has a generally cylindrical configuration with the diameter of the grip decreasing substantially uniformly from the cap end of the grip to the shaft end of the grip.

It is an object of this invention to provide a molded golf club grip of a uniaue new shape, designed for extra power and extra control. A "knob effect" at the cap end provides a secure feel for a more confident grip and better control. The slightly undersized top one-third promotes hand and wrist action for added power, while the less tapered and more uniform size at the lower two-thirds of the grip discourages over controlling the club and permits a smoother, more natural release.

FIG. 1 of the drawings is a longitudinal cross-section through a golf club shaft with a grip mounted thereon of conventional construction.

Figure 1:
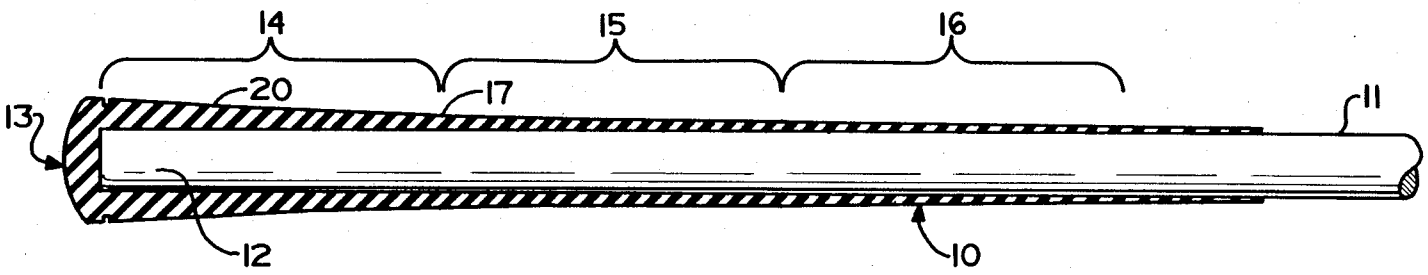
FIG. 1 PRIOR ART

Referring to FIG. 1 of the drawings, a conventional or standard grip 10 is shown mounted on a standard golf club shaft 11. The grip 10 has a circular internal and external cross section when taken substantially perpendicular to the longitudinal axis of the grip. The grip is molded of a rubber compound, and has an internal diameter slightly smaller than the external diameter of the golf club shaft 11. With the grip mounted on the shaft 11, the upper end 12 of the shaft extends to the cap end 13 of the grip.

The standard grip 10 has an upper end portion 14, a mid portion 15, and a lower portion 16. The upper portion 14 extends from the cap end 13 to a point approximately 3 inches longitudinally on the grip which is approximately one-third of the length of the grip. It is this upper portion 14 that is grasped by the left hand of a right-handed golfer. The mid portion 15 is grasped by the right hand of a right-handed golfer. At the juncture 17 of portions 14 and 15, the diameter of a standard grip is approximately 0.860 inches.

Figure 3:
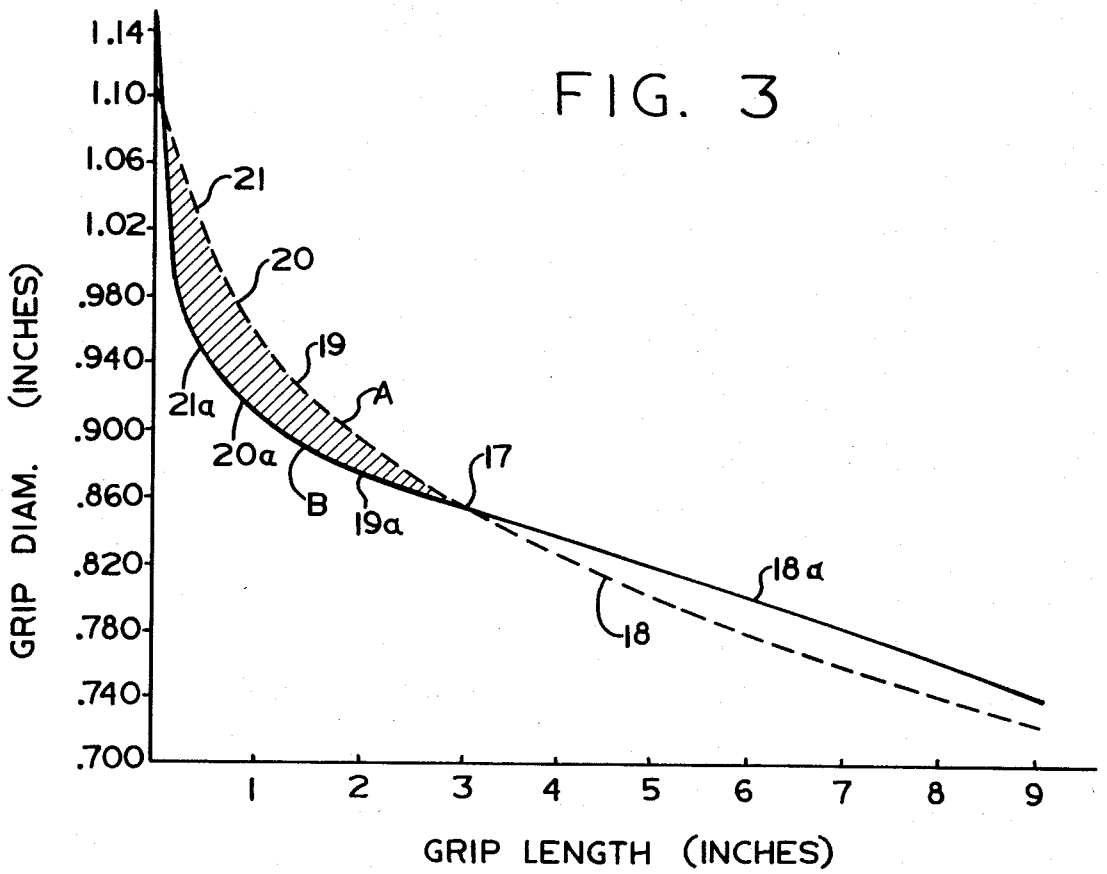
FIG. 3 is a graph plotting the golf club grip diameter versus the length of both a conventional grip and the grip of this invention.

In FIG. 3 of the drawings, the dash line A is a plot or graph of the diameter of the standard grip 10 plotted at various locations along the length of the grip. The diameter of the standard grip 10 decreases progressively through portions 15 and 16 towards the lower or shaft end 16*a* of the grip. As further shown in FIG. 3, the segment 18 of the line A, representing portions 15 and 16 of the grip, has a slope of approximately 0.023. The slope is the ratio of the change in the grip diameter over the grip length of a given segment of line A. The segment 19 of the line A has a slope approximately 0.05 from the juncture 17 to the juncture 20, which is located approximately one inch from the cap end of the grip. The segment 21 of the line A, situated between the juncture 20 and the cap end 13 of the grip, has a slope of approximately 0.16 and obviously is substantially steeper or greater than the slope either segments 18 or 19.

From the above it is seen that the diameter of the standard grip 10 decreases rather rapidly from the cap end 13 to the juncture 20, as shown by segment 21 of line A. The diameter decreases less rapidly through the segment 19 than segment 21 and more quickly slowly through the mid portion 15 and lower portion 16, as represented by the segment 18 of the line A in FIG. 3.

Figure 2:
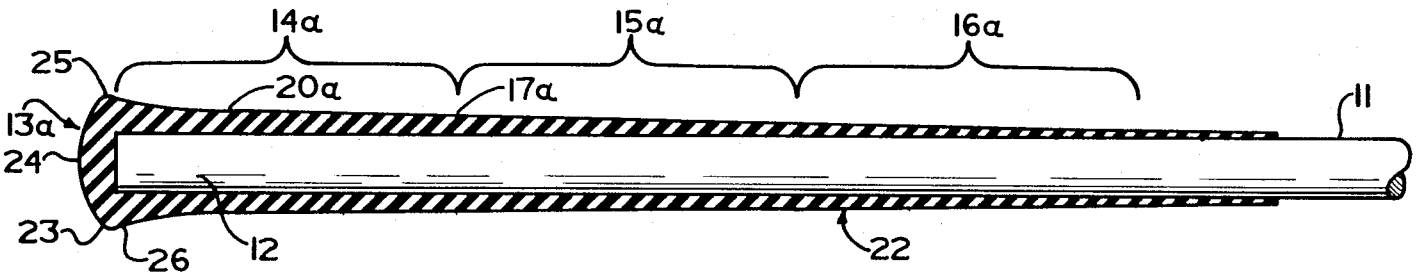
FIG. 2 is a cross sectional view similar to FIG. 1 of the golf club grip of the present invention.

FIG. 2 of the drawings shows the grip 22 of this invention with certain elements and portions thereof corresponding to the standard grip 10, indicated by numerals corresponding to those of FIG. 1 with the addition of the letter a. The cap end 13*a* of the grip 22 is formed in the shape of a knob 23 having a convex cap end portion 24 and with a maximum diameter at 25 greater than 1 inch located approximately one-fourth inch from the cap end 24. The knob neck 26 extends from the maximum diameter 25 in a curvilinear path, and joins the upper portion 14*a* approximately one-fourth inch from the maximum diameter 25.

The solid line B in FIG. 3 of the drawing is a plot or graph of the diameter of the grip 22 plotted at various locations along the length of the grip 22.

As shown in FIG. 3, the segment 19*a* of the solid line B has a slope of 0.03 and represent the changes in diameter of of the upper portion 14A of the grip of this invention. The area shown in cross hatching between the segments 21 and 19 of line A, and 21*a* and 19*a* of line B, represent the difference in diameter between the upper portion 14 of the standard grip shown in FIG. 1 and the upper portion 14*a* of the grip of this invention shown in FIG. 2. It is thus seen that the diameter of the upper portion 14*a* of the grip 22 is undersized or less than the standard grip, so that in conjunction with the knob 23, the left hand of a right-handed golfer is provided with a secure feel for a more confident grip and better control. At the same time the undersized upper portion of the grip promotes hand and wrist action. As further shown in FIG. 3, the segment 19*a* and 20*a* of solid line B correspond with segments 19 and 20 of line A. Segment 19*a* extends from juncture 17 to the juncture 20*a*. Juncture 17 is located at approximately 3 inches from cap end 13*a*. The diameter of the grip 22 at juncture 17 is the same as grip 10, or 0.860 inches. Furthermore, as shown in FIG. 3, the slope segment 19*a* of line B is approximately 0.03 since the diameter at juncture 17 is 0.860 inches and 0.920 inches at juncture 20*a* which is 2 inches from juncture 17. Thus the slope of segment 19*a* is 0.06 divided by 2 or 0.03.

The mid portion 15*a* and lower portion 16*a* of the grip 22 gradually decreases in diameter to the lower end of the grip, as shown by the segment 18*a* of the solid line B in FIG. 3. The segment 18*a* has a slope of approximately pb 0.02 since the diameter of grip 22 at juncture 17 is 0.860 inches and 0.740 inches at the end of segment 18*a* of solid line B as shown in FIG. 3. Thus the slope of segment 18*a* is 0.860 minus 0.740 divided by 6, the length in inches of segment 18*a* of solid line B, or 0.02. Thus, the mid-portion 15*a* and lower portion 16*a* of grip 22 has less taper and is slightly oversized from the standard grip 10, which discourages over controlling of the club with the right hand of a right-handed golfer and permits a smoother more natural release.

I claim:

1. A golf club adapted to be mounted on a shaft of a golf club comprising an elongated body formed from a moldable resilient material, said body having a longitudinal axis and an external surface having a substantially circular cross sectional configuration throughout the length of said body, an elongated cavity disposed coaxially to the longitudinal axis of said body and adopted to receive a club shaft, the internal surface of the cavity being substantially circular in cross section and of uniform diameter, said grip at approximately three inches from the upper end thereof having a first diameter of approximately 0.860 inches, the diameter of said grip progressively increasing from said first diameter towards the cap end of said grip at a rate of approximately 0.030 inches per inch of length for a distance of approximately two inches from said first diameter, said diameter continually increasing progressively toward the cap end of said grip to a maximum diameter greater than one inch located adjacent the cap end, the lower two-thirds of said grip decreasing in diameter, from said first diameter, at a rate of 0.02 inches per inch of length of the grip toward the end opposite the end cap, whereby the grip at the upper one-third thereof provides a secure feel for a more confident grip with a golfer's hand and better control of the golf club, and the lower two-thirds thereof discourages overcontrolling the club with other hand.

* * * * *